US007282035B2

(12) United States Patent
Huang

(10) Patent No.: US 7,282,035 B2
(45) Date of Patent: Oct. 16, 2007

(54) PHYSIOTHERAPEUTIC APPARATUS FOR RESTORING LOWER LIMB FUNCTION

(76) Inventor: Chi-Tzung Huang, No. 20, Industry 3rd Road, Min Hsiung, Chia Yi Hsien (TW)

( * ) Notice: Subject to any disclaimer, the term of this patent is extended or adjusted under 35 U.S.C. 154(b) by 86 days.

(21) Appl. No.: 11/353,054

(22) Filed: Feb. 14, 2006

(65) Prior Publication Data

US 2007/0191744 A1 Aug. 16, 2007

(51) Int. Cl.
*A61H 1/02* (2006.01)

(52) U.S. Cl. ..... 601/5; 601/33; 601/34

(58) Field of Classification Search ..... 601/5, 601/23, 24, 26, 27, 29, 30–35, 90, 93, 98, 601/101, 104
See application file for complete search history.

(56) References Cited

U.S. PATENT DOCUMENTS 4,974,830 A * 12/1990 Genovese et al. ..... 601/29
5,228,432 A * 7/1993 Kaiser et al. ..... 601/34
5,239,987 A * 8/1993 Kaiser et al. ..... 601/34
5,273,520 A * 12/1993 Rebmann ..... 602/5
6,325,770 B1 * 12/2001 Beny et al. ..... 601/34

* cited by examiner

*Primary Examiner*—Quang D. Thanh
(74) *Attorney, Agent, or Firm*—Rosenberg, Klein & Lee

(57) ABSTRACT

A physiotherapeutic apparatus includes a bed, a sliding mechanism, and a connecting rod combination; the bed has thereon a threaded rod, an actuating device for causing rotation of the threaded rod, and a circuit controller for controlling motion of the actuating device; the bed has two lateral rails, and a lengthways-extending rail, which are parallel to the threaded rod; the sliding mechanism has rolling wheels thereon, which fit in and roll along each one of the rails for increasing motion smoothness and steadiness, preventing tilting and reducing wear; a threaded sleeve is secured to the sliding mechanism and positioned around the threaded rod so that rotation of the threaded rod will cause forward and backward motion of the sliding mechanism; the connecting rod combination is foldable and used to fix a user's lower limbs, and it is pivoted to the bed and the sliding mechanism two ends thereof.

9 Claims, 6 Drawing Sheets

PHYSIOTHERAPEUTIC APPARATUS FOR RESTORING LOWER LIMB FUNCTION

BACKGROUND OF THE INVENTION

1. Field of the Invention

The present invention relates to a physiotherapeutic apparatus for restoring lower limb function, more particularly one, which includes two lateral guide rails, a lengthways extending guide rail, a sliding mechanism, and several rolling wheels fitted to the sliding mechanism and moving along the guide rails; thus, the sliding mechanism can move forwards and backwards in a steady and smooth manner without possibility of being tilted sideways, and wear is reduced and service life of the physiotherapeutic apparatus increases.

2. Brief Description of the Prior Art

People who are seriously injured or sick usually have to be hospitalized to receive treatment. During medical treatment, patients will receive physiotherapeutic treatment in order to prevent joint stiffness, muscle atrophy, bedsores etc owing to lack of exercise. Physiotherapeutic treatment can help prevent post-surgical swelling and reduce pain, and massages are delivered to the elderly and those who can't leave beds to prevent deterioration in muscle function.

However, the elderly and those who can't leave beds can't receive prompt and sufficient physiotherapeutic treatment if there aren't enough physiotherapeutic technicians available. There are various types of physiotherapeutic apparatus available for restoring functions of different body parts, e.g. hands, moving joints and muscles of shoulders, thighs, calves, feet, and ankles; when a physiotherapeutic apparatus is used to restore the function of ankles, the ankle joints will be rotated within a certain angle. U.S. Pat. No. 5,228,432 and U.S. Pat. No. 4,974,830 teach physiotherapeutic apparatuses, which move to stretch and bend a user's lower limbs after the user's lower limbs are adjusted in position and fixed thereto, thus preventing joint stiffness and muscle atrophy.

However, the above-mentioned currently existing lower limb physiotherapeutic apparatuses can't move in a smooth and steady manner, prone to sway and making the user feel uncomfortable and insecure. And, the parts of the physiotherapeutic apparatuses will wear and have shorter service life.

SUMMARY OF THE INVENTION

It is a main object of the invention to provide an improvement on a physiotherapeutic apparatus for restoring lower limb function to overcome the above-mentioned problems.

The apparatus of the present invention includes a bed, a sliding mechanism, and a connecting rod combination. The bed has thereon a threaded rod, an actuating device for causing rotation of the threaded rod, and a circuit controller for controlling motion of the actuating device. The bed has two lateral guide rails, and a lengthways-extending guide rail, which are parallel to the threaded rod. The sliding mechanism has several rolling wheels fitting in and rolling along each one of the guide rails for increasing motion smoothness and steadiness, preventing tilting and reducing wear; a threaded sleeve is secured to the sliding mechanism and positioned around the threaded rod so that rotation of the threaded rod will cause forward and backward motion of the sliding mechanism. The connecting rod combination is used to fix a user's lower limbs, and it is foldable, and pivoted to the bed and the sliding mechanism at two ends thereof.

Therefore, the sliding mechanism can move in a steady and smooth manner without possibility of being tilted sideways

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
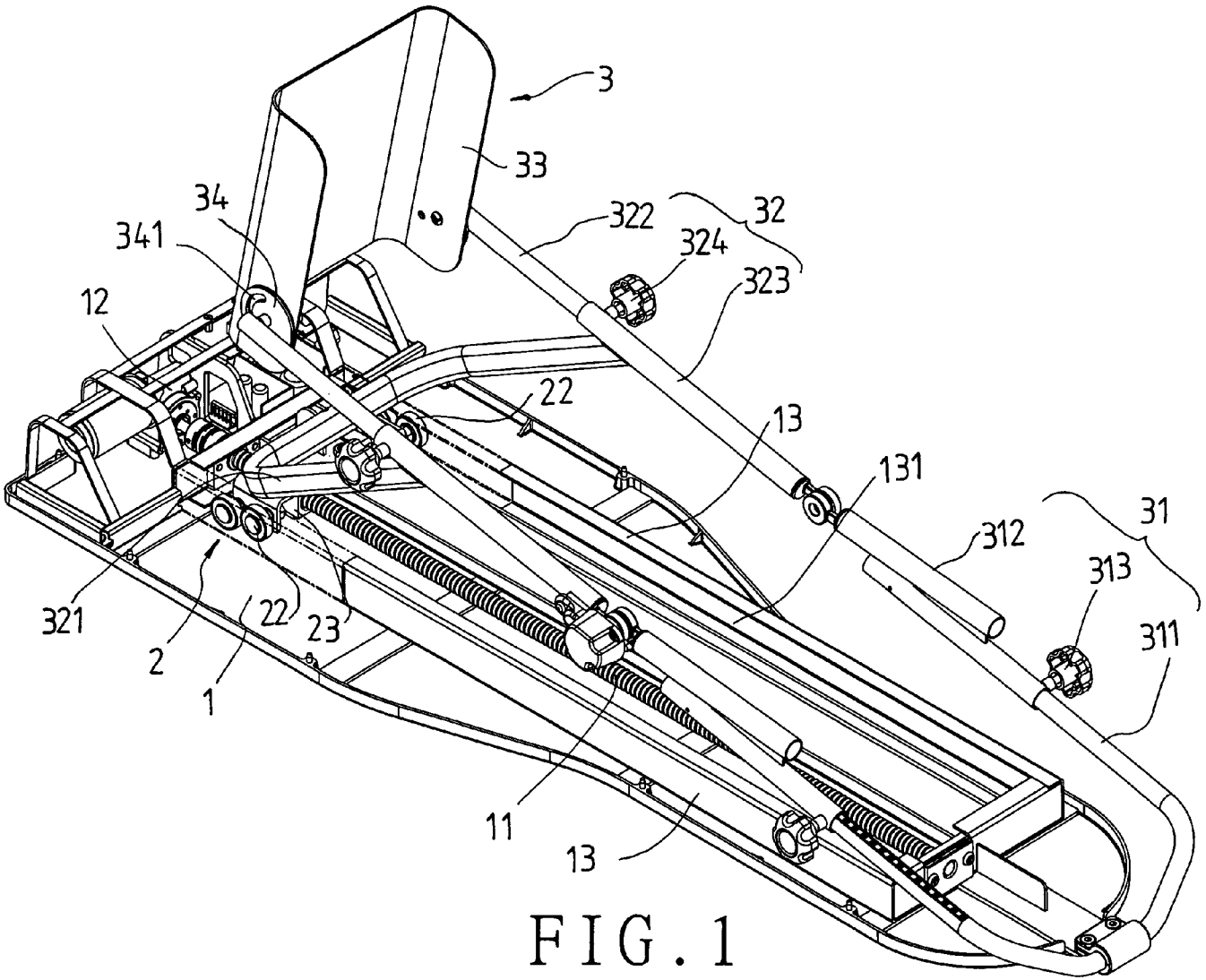
FIG. 1 is a perspective view of the physiotherapeutic apparatus in the present invention, excluding the cover.
Figure 2:
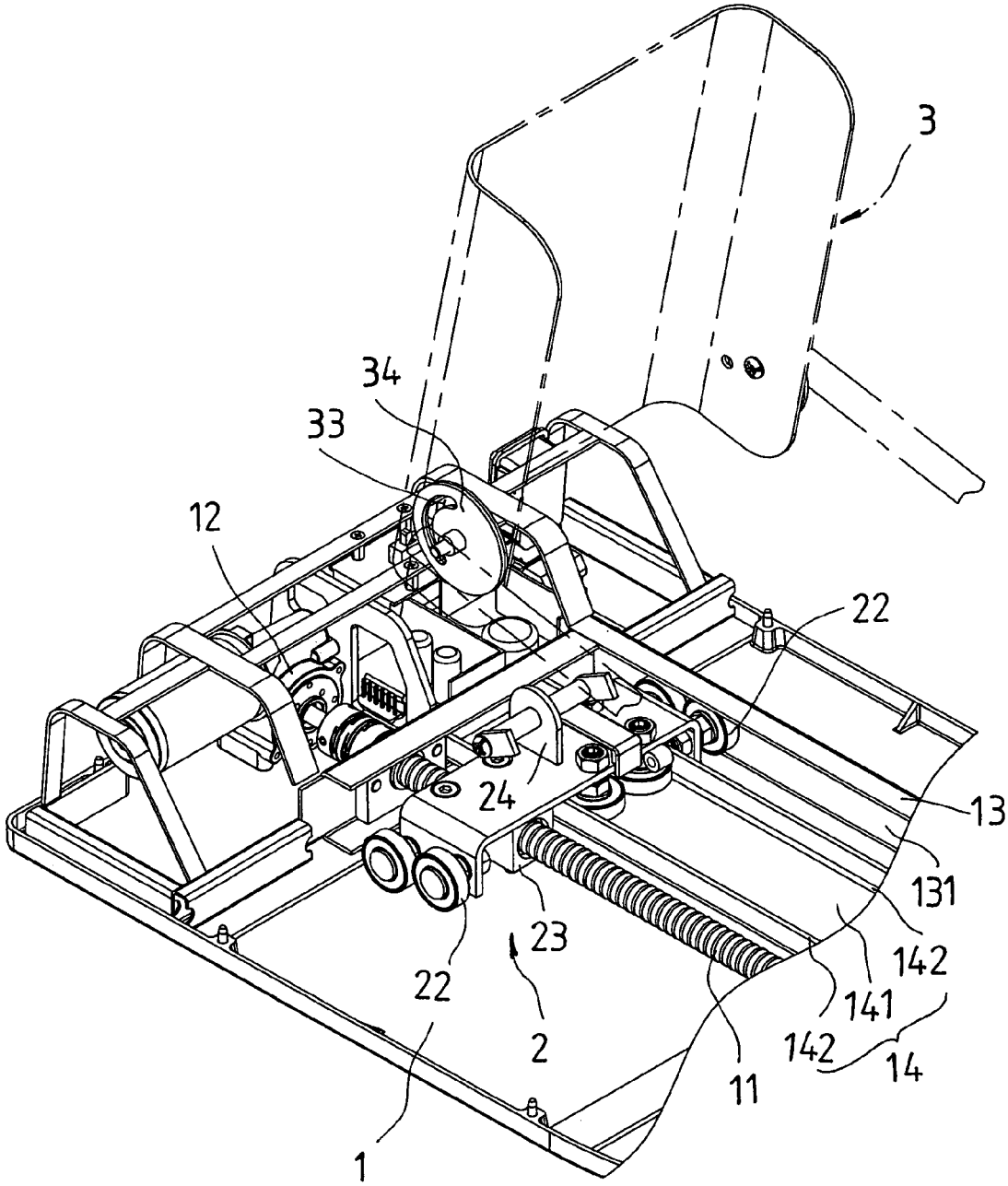
FIG. 2 is a partial perspective view of the present invention.
Figure 3:
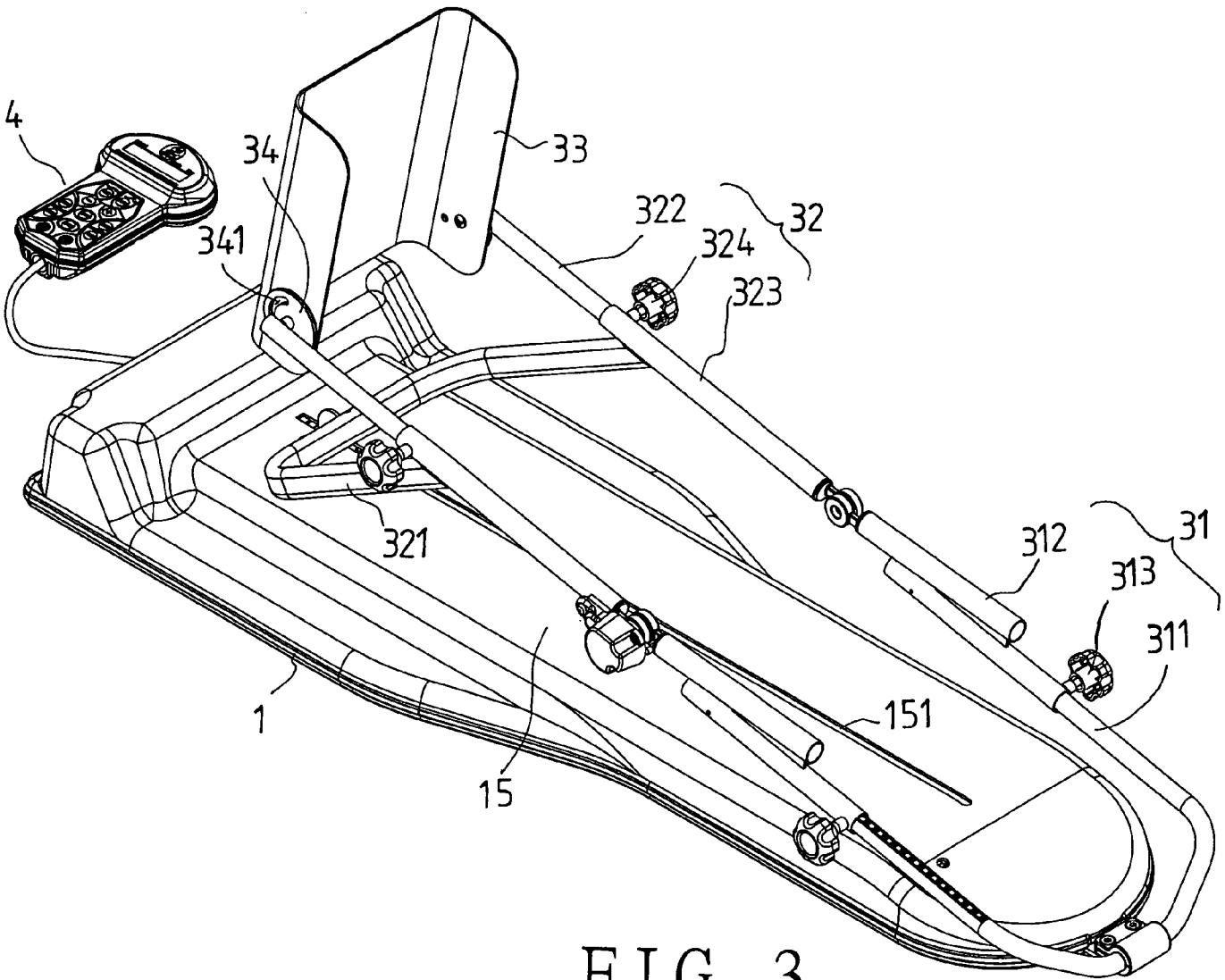
FIG. 3 is a perspective view of the physiotherapeutic apparatus in the present invention.
Figure 4:
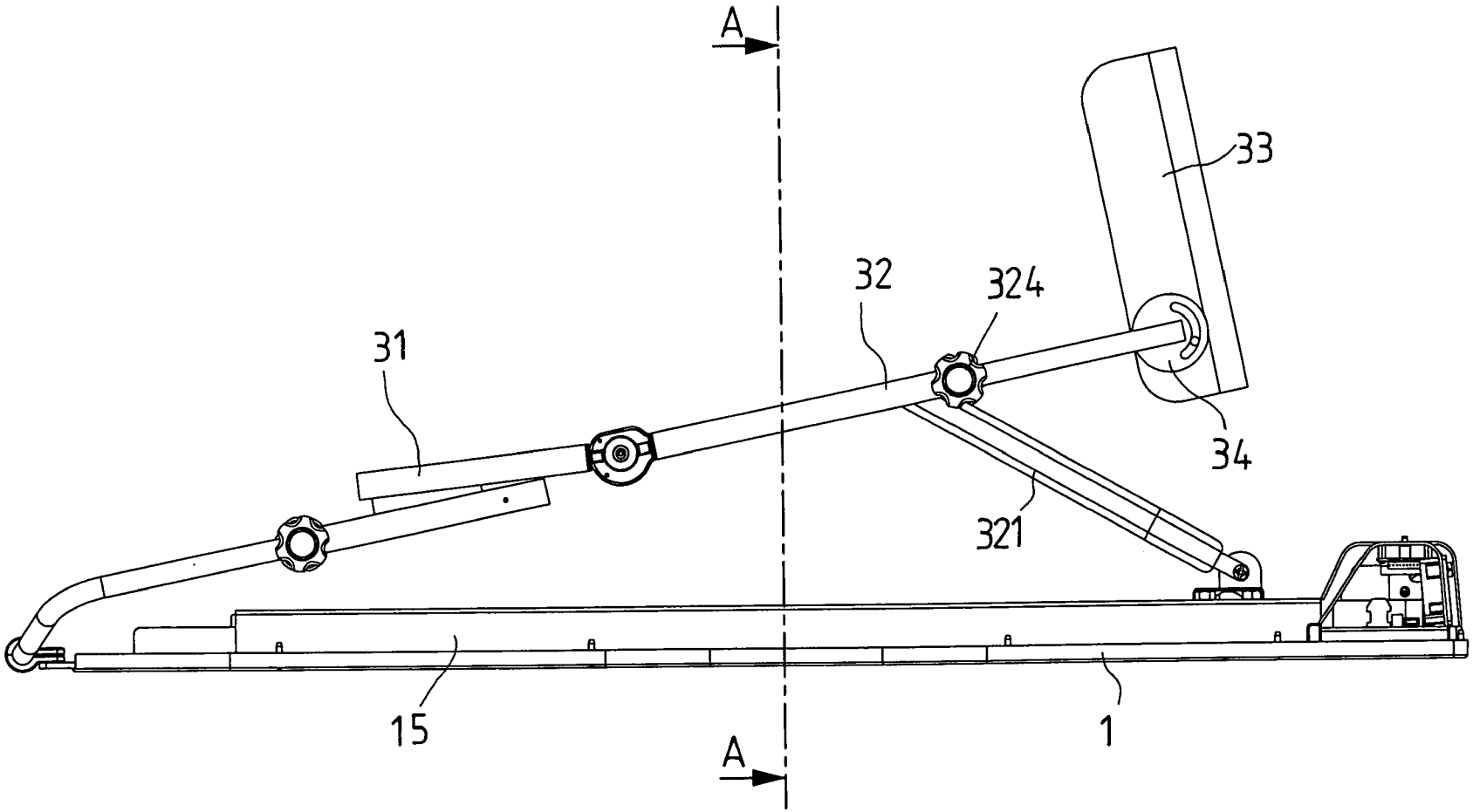
FIG. 4 is a side view of the present invention.
Figure 5:
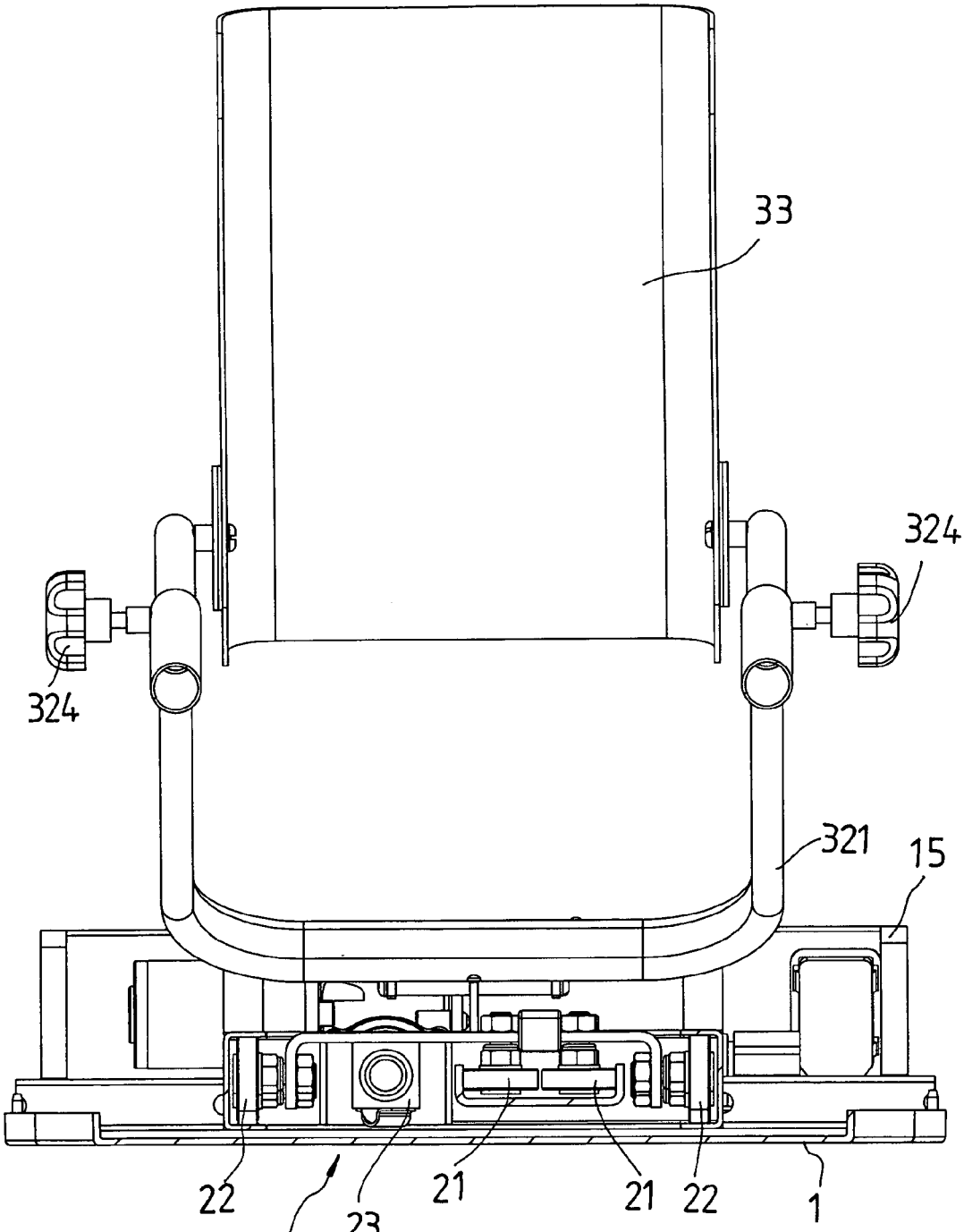
FIG. 5 is a sectional view of the present invention, taken along section line A-A of FIG. 4.
Figure 6:
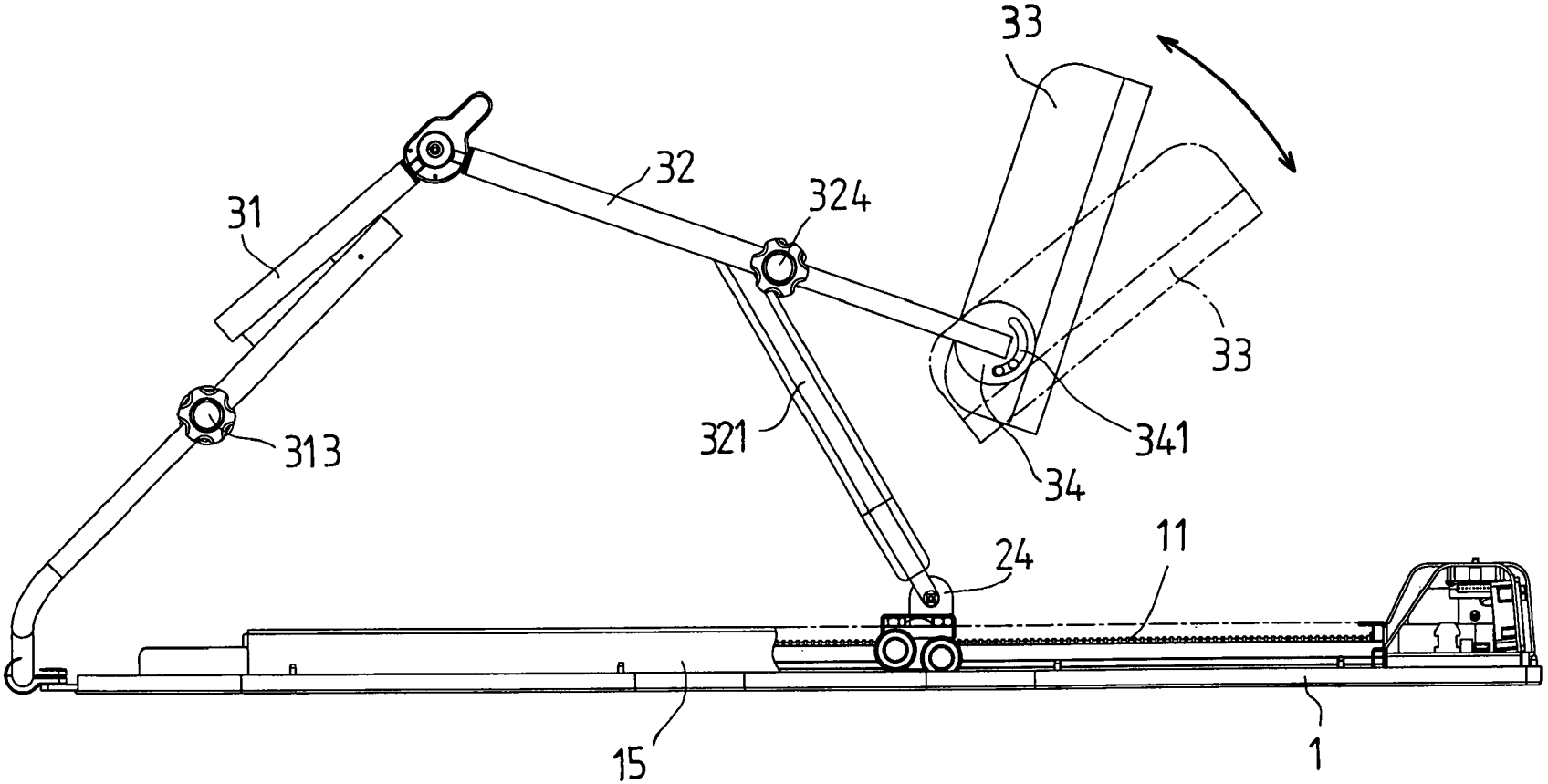
FIG. 6 is a view of the present invention in motion.

Referring to FIGS. 1 to 6, a preferred embodiment of a physiotherapeutic apparatus for restoring lower limb function includes a bed 1, a sliding mechanism 2, and a connecting rod combination 3.

The bed 1 has a threaded rod 11, a threaded rod actuating device 12, two lateral guide rails 13, and a lengthways-extending guide rail 14 thereon. The threaded rod 11, the lateral guide rails 13, and the lengthways-extending guide rail 14 are parallel. The two lateral guide rails 13 are positioned on two sides of the lengthways-extending guide rail 14, and they each have a lengthways-extending hollowness 131 therein; the lengthways-extending hollownesses 131 face each other. The lengthways-extending guide rail 14 has a lengthways-extending hollowness 141 therein, and it has a substantially U-shaped cross-section, and a lengthways-extending protrusion 142 on each of upper ends of inward sides of lateral portions thereof. The threaded rod actuating device 12 is connected to the threaded rod 11 for causing rotational motion of the threaded rod 11. A circuit controller 4 is electrically connected to the threaded rod actuating device 12 on the bed 1 for controlling motion of the threaded rod actuating device 12; therefore, direction, speed, and duration of rotational motion of the threaded rod 11 can be controlled with the circuit controller 4, and the circuit controller 4 can be used to set direction, speed, and duration of rotational motion of the threaded rod 11.

The sliding mechanism 2 includes an inverted U shaped main body, longitudinally rolling wheels 21, lateral rolling wheels 22, a threaded sleeve 23, and a protruding member 24; the rolling wheels 21 and 22 can be bearings. The threaded sleeve 23 is secured on a down-facing side of the main body of the sliding mechanism 2, and positioned around the threaded rod 11; thus, rotational motion of the threaded rod 11 will cause forward and backward linear displacement of the sliding mechanism 2. The lateral rolling wheels 22 are supported on two lateral sides of the inverted U shaped main body of the sliding mechanism 2, and fitted in the lengthways-extending hollownesses 131 of the lateral guide rails 13. The longitudinally rolling wheels 21 are fitted on the down-facing side of the inverted U shaped main body of the sliding mechanism 2, and fit in the lengthways-extending hollowness 141 of the lengthways-extending guide rail 14. The longitudinally rolling wheels 21 are arranged into several pairs, and each pair of longitudinally rolling wheels 21 touch respective ones of inward sides of lateral portions of the lengthways-extending guide rail 14.

The lateral rolling wheels 22 on each side are arranged into a row, and movable along the respective lengthways-extending hollowness 131. Therefore, when the threaded rod 11 is rotating, the sliding mechanism 2 will move smoothly along the guide rails 13 and 14 with the rolling wheels 21 and 22 constantly touching the inward sides of the guide rails 13 and 14; even if tilting moment is applied to the sliding mechanism 2, the longitudinally rolling wheels 21 will touch and smoothly roll along the inward sides of the lateral portions of the guide rail 14, and the lateral rolling wheels 22 will touch and smoothly roll along the guide rails 13.

The connecting rod combination 3 includes a first support rod 31, a second support rod 32, and a sole pressed member 33. The first support rod 31 is pivoted to the bed 1 at one end, and pivoted to the second support rod 31 at the other end. The sole pressed member 33 is pivoted to one end of the second support rod 32, and an angle adjustment device 34 is fitted on the pivotal joint between the sole pressed member 33 and the second support rod 32 for adjusting angle between the sole pressed member 33 and the second support rod 32; the angle adjustment device 34 has a curved guide rail 341 so that the range of pivotal motion of the sole pressed member 33 is defined by the curved guide rail 341. Furthermore, the first support rod 31 includes an inner tube 311, two outer tubes 312 positioned around end portions of the inner tube 311, and two first fixing hand wheels 313 connected to the outer tubes 312; thus, the first support rod 31 is telescopic, adjustable in length, and the outer tubes 312 can be securely joined to the inner tube 311 by means of the fixing hand wheels 313 after the first support rod 31 has been adjusted to a proper length. The second support rod 32 includes a branch 321, two inner tubes 322, two outer tubes 323 each positioned around one end portion of a respective one of the inner tubes 322, and second fixing hand wheels 324 each passed through corresponding inner and outer tubes 322 and 323; thus, the second support rod 32 is telescopic, adjustable in length, and the outer tubes 323 can be securely joined to the corresponding inner tubes 322 by means of the second fixing hand wheels 324 after the second support rod 32 has been adjusted to a proper length. The second support rod 32 is pivoted to the sliding mechanism 2 at the branch 321 thereof. Therefore, the first and the second support rods 31 and 32 can be adjusted in length to suit leg length of users/patients.

Furthermore, a cover 15 is positioned right above the threaded rod 11 and the sliding mechanism 2 to prevent people from getting wounded when the threaded rod 11 and the sliding mechanism 2 are in motion. The cover 15 has a lengthways-extending aperture 151, and the protruding member 24 of the sliding mechanism 2 sticks out through the lengthways-extending aperture 151, and the branch 321 of the second support rod 32 is pivoted to the protruding member 24. Therefore, the protruding member 24 will move forwards and backwards along the lengthways-extending aperture 151 when the sliding mechanism 2 is in motion.

Because the sliding mechanism 2 is supported on the guide rails 13 and 14, it will be relatively steady without possibility of being tilted sideways when moving. Consequently, the connecting rod combination 3, on which a user's lower limbs are fixed, will also be relatively steady without possibility of swaying, not making the user feel insecure and uncomfortable. From the above description, it can be easily seen that the moving parts of the physiotherapeutic apparatus of the present invention can move in a steady manner without possibility of locking, and wear is reduced and service life increases, eliminating the problems that will come up in using the currently existing structures.

What is claimed is:

1. A physiotherapeutic apparatus for restoring lower limb function, comprising (a) a bed, the bed having thereon a threaded rod, an actuating device, the actuating device being connected to the threaded rod for causing rotational motion of the threaded rod;

a circuit controller, the circuit controller being connected to the actuating device for controlling motion of the actuating device;

two lateral guide rails, and a lengthways-extending guide rail; the threaded rod, the lateral guide rails, and the lengthways-extending guide rail being parallel;

(b) a sliding mechanism, the sliding mechanism being equipped with:

a plurality of longitudinally rolling wheels fitted in and rolling along the lengthways-extending guide rail, a plurality of lateral rolling wheels fitted in and rolling along each of the lateral guide rails, and a threaded sleeve, the threaded sleeve being positioned around the threaded rod so that rotational motion of the threaded rod will cause forward and backward linear displacement of the sliding mechanism;

(c) a connecting rod combination, the connecting rod combination being pivoted to the bed at one end, and pivoted to the sliding mechanism at other end thereof.

2. The physiotherapeutic apparatus for restoring lower limb function as recited in claim 1, wherein said two lateral guide rails each have a lengthways-extending hollowness, and the lengthways-extending hollownesses face each other.

3. The physiotherapeutic apparatus for restoring lower limb function as recited in claim 1, wherein said lengthways-extending guide rail has a lengthways-extending hollowness therein, a substantially U-shaped cross-section, and a lengthways-extending protrusion on each of upper ends of inward sides of lateral portions thereof, and said longitudinally rolling wheels are arranged into a plurality of pairs, and each pair of longitudinally rolling wheels touch respective ones of said lateral portion inward sides of the lengthways-extending guide rail.

4. The physiotherapeutic apparatus for restoring lower limb function as recited in claim 1, wherein said lateral rolling wheels are bearings.

5. The physiotherapeutic apparatus for restoring lower limb function as recited in claim 1, wherein said longitudinally rolling wheels are bearings.

6. The physiotherapeutic apparatus for restoring lower limb function as recited in claim 1, wherein a cover is positioned right above the bed; the cover having a lengthways-extending aperture, and the sliding mechanism having a protruding member sticking out through the lengthways-extending aperture.

7. The physiotherapeutic apparatus for restoring lower limb function as recited in claim 1, wherein said connecting rod combination includes a first support rod, a second support rod, and a sole pressed member; the first support rod being pivoted to the bed at one end, and pivoted to the second support rod at other end; the second support rod including a branch; the second support rod being pivotally connected to the sliding mechanism at the branch thereof; the sole pressed member being pivoted to one end of the second support rod; an angle adjustment device being fitted on a pivotal joint between the sole pressed member and the second support rod for adjusting angle between the sole pressed member and the second support rod.

8. The physiotherapeutic apparatus for restoring lower limb function as recited in claim 7, wherein said first support rod includes a plurality of inner tubes, outer tubes positioned around end portions of the inner tubes, and a plurality of first fixing hand wheels connected to the outer tubes for fixing the outer tubes to corresponding inner tubes; thus, said first support rod is telescopic and adjustable in length.

9. The physiotherapeutic apparatus for restoring lower limb function as recited in claim 7, wherein said second support rod includes a plurality of inner tubes, outer tubes each positioned around one end portion of a respective one of the inner tubes, and a plurality of second fixing hand wheels each passed through corresponding inner and outer tubes for securing corresponding inner and outer tubes together; thus, said second support rod is telescopic and adjustable in length.

* * * * *